US012735959B1

(12) United States Patent
Dave et al.

(10) Patent No.: US 12,735,959 B1
(45) Date of Patent: Sep. 15, 2026

(54) LINER HANGER HAVING EXPANDABLE SLEEVE

(71) Applicant: Halliburton Energy Services, Inc., Houston, TX (US)

(72) Inventors: Jalpan Piyush Dave, Singapore (SG); Atharv Abhijit Naik, Singapore (SG); Nithin Kumar Gupta Dachepally, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/287,599

(22) Filed: Jul. 31, 2025

(51) Int. Cl.
*E21B 43/10* (2006.01)

(52) U.S. Cl.
CPC ..... *E21B 43/103* (2013.01)

(58) Field of Classification Search
CPC ..... E21B 33/1243; E21B 33/127; E21B 43/103; E21B 43/108
See application file for complete search history.

(56) References Cited

U.S. PATENT DOCUMENTS

| | | | | |
|---|---|---|---|---|
| 9,353,606 | B2 * | 5/2016 | Bruce | E21B 43/10 |
| 11,136,864 | B2 * | 10/2021 | Hazelip | E21B 33/10 |
| 11,230,909 | B2 * | 1/2022 | Bermudez | E21B 43/103 |
| 11,692,411 | B2 * | 7/2023 | Vasques | E21B 33/127 166/179 |
| 12,196,055 | B2 * | 1/2025 | Vasques | E21B 33/1277 |
| 12,264,550 | B1 | 4/2025 | Mahendran et al. | |
| 12,312,901 | B2 * | 5/2025 | Vasques | E21B 33/127 |
| 12,398,624 | B2 * | 8/2025 | Zhong | E21B 43/103 |
| 12,473,795 | B2 | 11/2025 | Dave et al. | |
| 12,497,866 | B2 * | 12/2025 | Chevallier | E21B 43/103 |
| 12,529,292 | B2 * | 1/2026 | Fripp | E21B 43/103 |
| 2006/0090903 | A1 * | 5/2006 | Gano | E21B 33/12 166/387 |
| 2006/0237188 | A1 * | 10/2006 | McMahan | E21B 23/01 166/207 |
| 2008/0210440 | A1 * | 9/2008 | Stuart | E21B 43/103 166/207 |
| 2013/0341005 | A1 * | 12/2013 | Bruce | E21B 43/02 166/207 |

(Continued)

FOREIGN PATENT DOCUMENTS

| | | | | |
|---|---|---|---|---|
| CN | 111527280 A * | 8/2020 | | E21B 33/14 |
| CN | 111601947 A * | 8/2020 | | E21B 33/1208 |

OTHER PUBLICATIONS

International Search Report and Written Opinion for International Patent Application No. PCT/US2025/041877 dated Apr. 29, 2026. PDF file. 10 pages.

(Continued)

*Primary Examiner* — Jennifer H Gay
(74) *Attorney, Agent, or Firm* — Scott Richardson; C. Tumey Law Group PLLC

(57) ABSTRACT

A variety of methods and apparatus are disclosed, including, an expandable liner hanger and deploying an expandable liner hanger. The expandable liner includes an expandable sealing sleeve attached to a body of the expandable liner hanger to engage a casing in a wellbore to form a seal between the expandable liner hanger and the casing, the expandable sealing sleeve having hollow members to receive fluid from the wellbore to expand the expandable sealing sleeve.

18 Claims, 6 Drawing Sheets

(56) References Cited

U.S. PATENT DOCUMENTS

| | | | | |
|---|---|---|---|---|
| 2016/0053591 | A1* | 2/2016 | Hallundbæk | E21B 43/108 166/185 |
| 2020/0131881 | A1* | 4/2020 | Vasques | E21B 33/1243 |
| 2020/0149375 | A1* | 5/2020 | Bermudes | E21B 43/108 |
| 2020/0165892 | A1* | 5/2020 | Vasques | E21B 33/128 |
| 2020/0378220 | A1* | 12/2020 | Hazelip | E21B 23/04115 |
| 2021/0189830 | A1 | 6/2021 | Stephen et al. | |
| 2021/0198973 | A1 | 7/2021 | Fripp et al. | |
| 2022/0333456 | A1* | 10/2022 | Vasques | E21B 33/1272 |
| 2023/0147260 | A1* | 5/2023 | Vasques | E21B 43/103 166/387 |
| 2023/0220743 | A1* | 7/2023 | Vasques | E21B 33/1243 166/387 |
| 2023/0374884 | A1* | 11/2023 | Purkis | E21B 33/1277 |
| 2023/0392468 | A1 | 12/2023 | Fripp et al. | |
| 2023/0407730 | A1 | 12/2023 | Zhong et al. | |
| 2024/0068321 | A1 | 2/2024 | Havlinek | |
| 2024/0117716 | A1 | 4/2024 | Zhong et al. | |
| 2024/0151123 | A1* | 5/2024 | Loh | E21B 43/103 |
| 2024/0229614 | A1* | 7/2024 | Chevallier | E21B 43/103 |
| 2024/0337172 | A1* | 10/2024 | Roselier | E21B 23/01 |
| 2025/0020045 | A1* | 1/2025 | Zhong | E21B 43/10 |
| 2025/0043645 | A1 | 2/2025 | Milne et al. | |
| 2025/0146374 | A1 | 5/2025 | Thatathil et al. | |
| 2025/0314156 | A1 | 10/2025 | Dave et al. | |
| 2025/0320793 | A1* | 10/2025 | Glaesman | E21B 43/103 |

OTHER PUBLICATIONS

AM Media, The Cool Parts Show YouTube Video. "3D Printed Seal for Geothermal Power | The Cool Parts Show Ep.73." Uploaded Jul. 11, 2024. YouTube Website, https://www.youtube.com/watch?v=uYVORnXPOWE. Accessed Feb. 20, 2026.

* cited by examiner

LINER HANGER HAVING EXPANDABLE SLEEVE

BACKGROUND

Boreholes may be drilled into subterranean formations to recover valuable hydrocarbons, among other functions. Operations may be performed before, during, and after the borehole has been drilled to produce and continue the flow of the hydrocarbon fluids to the surface. A typical operation concerning downhole applications may be to apply a seal within a borehole. A seal may isolate and contain produced hydrocarbons and pressures within the borehole. There may be a variety of different tools and equipment used to create seals between the outside of a production tubing string and the inside of a casing string, liner, or the wall of a borehole (wellbore). Substantial pressure differentials across a seal may induce failure of the seal. Such may result in substantial loss of time, money, and equipment.

BRIEF DESCRIPTION OF THE DRAWINGS

These drawings illustrate certain aspects of some of the embodiments of the present disclosure and should not be used to limit or define the disclosure.

Like reference numbers and designations in the various drawings indicate like elements.

DETAILED DESCRIPTION

Disclosed herein are examples of expandable liner hangers having an expandable sealing sleeve as a sealing element. In operation, the sealing sleeve can be pushed against the wellbore casing (or liner) in the expansion of the expandable liner hanger forming a seal with the casing. For wellbore pressure acting against the seal, the expandable sealing sleeve can receive wellbore fluid (driven by wellbore pressure). In response, the expandable sleeve beneficially expands to maintain the seal. The expandable sealing sleeve can be characterized as a pressure-energized sleeve.

The expandable sealing sleeve can facilitate forming and maintaining a fluid seal in a wellbore annulus between the expandable liner hanger and the wellbore casing or liner. The expandable sealing sleeve can be situated on the liner hanger body, such as on the outside diameter (OD) [on the OD surface] of the liner hanger body.

In implementations, the expandable sleeve (e.g., metal) can be a three dimensional (3D) printed expandable sealing sleeve attached to the liner hanger body. In implementations, the expandable sealing sleeve can be 3D printed onto the liner hanger body. In implementations, the expandable sealing sleeve can be 3D printed separately and attached to the liner hanger body. In implementations, the expandable sealing sleeve can be machined (instead of 3D printed) and then attached to the liner hanger body.

The expandable sealing sleeve may be initially expanded against the wellbore casing by action of the expandable liner hanger in expanding to form seal(s) with casing. Further, the metal expandable sealing sleeve can be deformable (plastically deformable) to facilitate further expansion of the sleeve with receipt of wellbore fluid into the sleeve driven by wellbore pressure. In this expansion driven by the fluid and pressure in the wellbore, the expandable sealing sleeve may expand against both the wellbore casing and the expandable liner hanger body. This further expansion of the expandable sealing sleeve may be by wellbore pressure and/or differential pressure across the expandable sealing sleeve resulting from wellbore pressure.

As indicated, on setting of the expandable liner hanger in the wellbore, this sleeve can act as a seal against the pressure applied to the liner hanger. Inclusion of the expandable sealing sleeve on the expandable liner hanger can increase the pressure capability of the liner hanger. In implementations, the expandable liner hanger with the expandable sealing sleeve is applicable for high pressure service in the wellbore.

Figure 1:
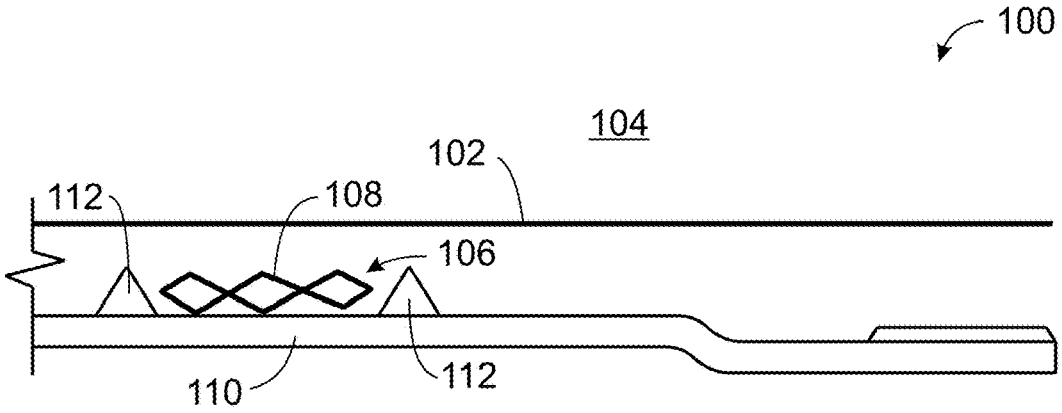
FIG. 1 is a diagram of an expandable liner hanger situated in a wellbore.

FIG. 1 is an expandable liner hanger 100 situated in a wellbore (having a casing 102) in a subterranean formation 104. A radial half of the expandable liner hanger 100 and wellbore casing 102 are depicted in a side view as a simplified cross-section for clarity. In this example, to the left is uphole toward the Earth surface, and to the right is downhole.

The expandable liner hanger 100 includes an expandable sealing sleeve 106, as discussed. In the illustrated embodiment, an example of the expandable sleeve 106 (pressure-energized sleeve) includes three hollow members 108 that are a simple diamond shape, e.g., having a tilted parallelogram cross section as depicted. The number of hollow members 108 can be, for example, in the range of 1 to 10. The hollow members 108 can be shapes or geometries other than diamond shape. A hollow member 108 is a deformable container having a wall around an interior volume (space). A hollow member 108 as metal (having a metal wall) can form a metal-to-metal seal with a metal casing 102 (or metal liner) in the wellbore. In embodiments, the expandable sealing sleeve 106 (e.g., metal) is 3D printed (additive manufacturing), e.g., 3D printed onto the liner hanger body 110 (e.g., tool mandrel, liner, etc.). The expandable sleeve 106 as a sealing element may form a seal with the casing 102 between the liner hanger 100 and the casing 102. In embodiments, the casing 102 can instead be a liner in the wellbore in which the seal is formed.

The expandable liner hanger 100 includes a body 110 and raised portions 112 attached to the body 110. In this example, the expandable sealing sleeve 106 is attached to the body 110 between the two depicted raised portions 112. Such a configuration may make use of an assembly tool to assemble the sleeve over the hanger raised portions 112 (e.g., spikes). The expandable liner hanger 100 can have more than two raised portions 112 attached to the body 110. A raised portion 112 (e.g., elastomer and/or metal) can be, for example, a spike (as depicted) or a spike form, a ring, ridges, ribs, a band, and/or a rubber sleeve, and so on. A raised portion 112 can be, for instance, a seal (sealing element) to form a seal with the casing 102, and/or an anchor to anchor that raised portion 112 (and thus anchor the liner hanger 100) to the casing 102. In implementations, the raised portions 112 are metal spikes (or generally have a spike form) or metal ribs.

In alternate embodiments to that depicted, the sleeve 106 can be situated on the body 110 uphole of the uphole raised portion 112 or downhole of the downhole raised portion 112. The sleeve 106 can be retained in place with a top sub/bottom sub (sub can be a form of attachment), snap ring, lock ring, etc. so that the sleeve 106 is retained on the liner hanger body 110. These retaining features can be characterized as secondary retaining in addition to the retaining provided for the expandable sleeve 106 as 3D printed onto the body 110 in those implementations.

The expandable sealing sleeve 106 including the hollow members 108 can be a deformable structure such that the sleeve 106 can expand. In operation, the sleeve 106 is expanded by radial expansion of the expandable liner hanger toward the casing 102. Further expansion of the sleeve 106 can be driven by pressure (e.g., wellbore pressure). In other words, the expandable sleeve 106 is generally a pressure-energized sleeve. For instance, wellbore fluid driven by wellbore pressure can enter the interior space of the hollow members 108 to pressurize and expand the hollow members 108 and thus expand the expandable sleeve 106 (e.g., including toward the casing 102). Such may facilitate forming and/or maintaining a seal of the liner hanger 100 with the casing 102.

In implementations, the expandable liner hanger is configured to form and maintain the seal at a pressure of the wellbore fluid up to 17,000 pounds per square inch gauge (psig) and at least 17,000 psig. In implementations, the expandable liner hanger is configured to form and maintain the seal subjected to a pressure differential up to 17,000 psi and at least 17,000 psi.

Incorporation of the expandable sealing sleeve 106 in the expandable liner hanger 100 can configure the liner hanger 100 for wellbore pressures, for example, of at least 17,000 psig at reference ambient temperature (e.g., 20-30° C.), and for a differential pressure of at least 17,000 pounds per square inch (psi) across the hanger 100. It can be both above and below pressure depending upon where the sleeve is attached. For a below (downhole) pressure of 17,000 psig, the differential pressure can be 17,000 psi. The expandable liner hanger 100 with the expandable sealing sleeve 106 can be configured for pressure capability (rating) in maintaining a seal with the casing 102 at pressures in the range of 17,000 psig to 25,000 psig, 17,000 psig to 22,000 psig, or 17,000 psig to 20,000 psig. This pressure can be the pressure from below (downhole) in the wellbore, e.g., the below or downhole pressure at the liner hanger 100. This pressure can be the pressure from above (uphole) in the wellbore. The expandable liner hanger 100 with the expandable sealing sleeve 106 can be configured for a pressure differential capability (rating) axially or longitudinally across the hanger 100 in maintaining a seal with the casing 102 at pressures in the range of 17,000 psi to 25,000 psi, 17,000 psi to 22,000 psi, or 17,000 psi to 20,000 psi. Of course, these implementations of the expandable liner hanger 100 can form and maintain the second seal at a pressure of the fluid less than 17,000 psig [e.g., 0 psig to 25,000 psig, 0 psig to 22,000 psig, or 0 psig to 20,000 psig] and at a pressure differential less than 17,000 psi [e.g., 0 psi to 25,000 psi, 0 psi to 22,000 psi, or 0 psi to 20,000 psi].

Embodiments of the present techniques rely on radial forces/expansion of the liner hanger 100/sealing sleeve 106 to generate the expansion and form the sealing or seal. In implementations, little or no axial force is utilized to form the seal. The application of an expansion cone can apply some axial force in implementations.

Embodiments include the expandable liner hanger 100 without the raised portions 112 but with the expandable sealing sleeve 106. In those embodiments, the liner hanger 100 can include additional sealing elements (e.g., a rubber sleeve) to form a second seal with the casing 102 in addition to the seal formed via the expandable sealing sleeve 106. For the example of the additional rubber sleeve, the rubber sleeve is a sealing element.

Figure 2:
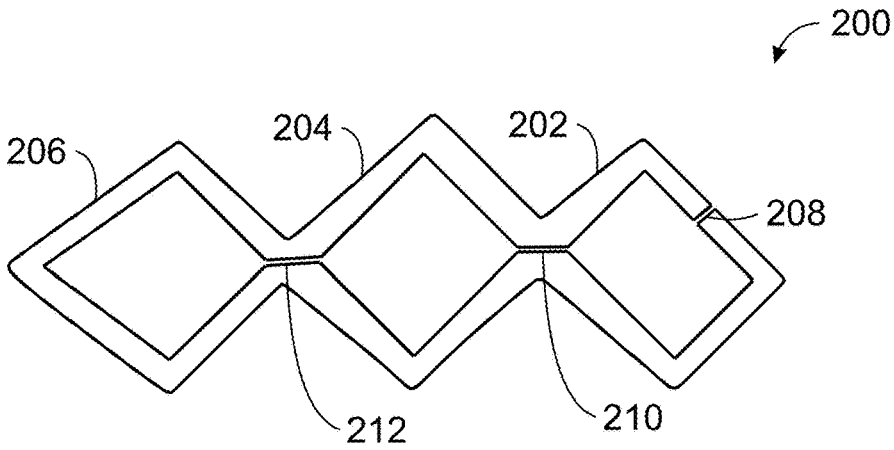
FIG. 2 is a simplified cross section of an expandable sealing sleeve.

FIG. 2 is a simplified cross section of an expandable sealing sleeve 200. The expandable sealing sleeve 200 (pressure-energized sleeve) can be analogous to the expandable sealing sleeve 106 of FIG. 1. The expandable sealing sleeve 200 can be utilized as the expandable sleeve 106 of FIG. 1. In this example, the expandable sealing sleeve 200 has three coupled hollow members 202, 204, 206 each having a simple diamond shape, e.g., a cross section as a parallelogram, rectangle, or square and in which two sides meet at an upper point and two sides meet at a lower point. Shapes other than diamond shape are applicable. In the illustrated embodiment, three channels 208, 210, 212 (e.g., microchannels) are formed in the collection of the hollow members 202, 204, 206.

The first microchannel 208 (hole) is formed in the wall of the hollow member 202 (at the downhole end). In operation, the first microchannel 208 is configured to receive fluid (e.g., wellbore fluid) into the interior volume (space) of the downhole hollow member 202. The second microchannel 210 (hole) is formed in the walls of the downhole hollow member 202 and the middle hollow member 204 to fluidly connect the interior volume of the downhole hollow member 202 to the interior volume of the middle hollow member 204. The third microchannel 212 (hole) is formed in the walls of the middle hollow member 204 and the uphole hollow member 206 to fluidly connect the interior volume of the middle hollow member 204 to the interior volume of the uphole hollow member 206. The microchannels 208, 210, 212 can each have a diameter, for example, less than 100 microns, e.g., in the range of 10 microns to 100 microns.

In operation in the wellbore, fluid (e.g., wellbore fluid) driven by pressure enters through the first microchannel 208 into the interior volume of the downhole hollow member 202, thus pressurizing and expanding the downhole hollow member 202. The fluid flows by pressure differential from the interior volume of the downhole hollow member 202 through the second microchannel 210 into the interior volume of the middle hollow member 204, thus pressurizing and expanding the middle hollow member 204. The fluid flows by pressure differential from the interior volume of the middle hollow member 204 through the third microchannel 212 into the interior volume of the uphole hollow member 206, thus pressurizing and expanding the uphole hollow member 206. This expansion of the expandable sealing sleeve 200 is thus caused by wellbore pressure against the liner hanger (e.g., liner hanger 100 of FIG. 1). In implementations, each hollow member 202, 204, 206 can be considered a seal or sealing element. For instance, for applications against below pressure, the downhole hollow member 202 can be a primary seal and the hollow members 204, 206 as backup seals. Other configurations are applicable.

Figure 3:
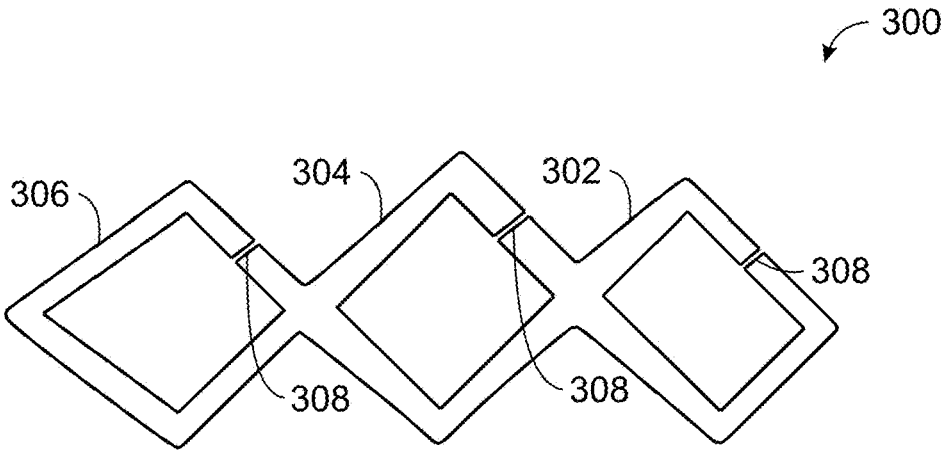
FIG. 3 is a simplified cross section of an expandable sealing sleeve.

FIG. 3 is a simplified cross section of an expandable sealing sleeve 300. The expandable sealing sleeve 300 (pressure-energized sleeve) can be analogous to the expandable sealing sleeve 106 of FIG. 1 and the expandable sealing sleeve 200 of FIG. 2. The expandable sealing sleeve 300 can be utilized as the expandable sleeve 106 of FIG. 1. In this example, the expandable sealing sleeve 300 has three coupled hollow members 302, 304, 306 each having a simple diamond shape. Other shapes are applicable. Each hollow member 302, 304, 306 has a respective microchannel 308 (hole) in their wall to receive wellbore fluid into their interior volume. The microchannels 308 can have a diameter, for example, less than 100 microns, e.g., in the range of 10 microns to 100 microns.

In operation in the wellbore, fluid (e.g., wellbore fluid) driven by pressure (e.g., wellbore pressure) enters through the microchannels 308 into the interior volume of the hollow members 302, 304, 306, thus pressurizing and expanding the hollow members 302, 304, 306 and therefore expanding the expandable sealing sleeve 300. This expansion of the expandable sealing sleeve 300 thus can be caused by wellbore pressure against the liner hanger (e.g., liner hanger 100 of FIG. 1). In implementations, each hollow member 302, 304, 306 can be considered a seal or sealing element. For instance, for applications against below pressure, the downhole hollow member 302 can be a primary seal and the hollow members 304, 306 as backup seals.

With respect to FIGS. 1-3 in operation with below pressure being applied on the liner hanger, the expandable sealing sleeve may already be acting as a metal-to-metal (MTM) seal between the hanger and the casing. As the below pressure is applied or increases, the applied below pressure can further enhance the seal because of the presence of the microchannel(s) and hollow interior(s) of the expandable sealing sleeve. Thus, in implementations, the applied pressure can give an extra boost to the MTM seal created by the expandable sealing sleeve. Hence, the technique can be applicable to seal higher pressures for high pressure-high temperature (HPHT) applications. A similar expandable sealing sleeve can be assembled onto the top (uphole side) of the liner hanger, inverted to seal against above (uphole) pressure.

Again, the shapes of the hollow members of the expandable sealing sleeve in FIGS. 1-3 can be different than diamond shape. Further, other configurations (e.g., position, placement, operation, number, etc.) of the microchannels of the hollow members of the expandable sealing sleeve are applicable.

Figure 4:
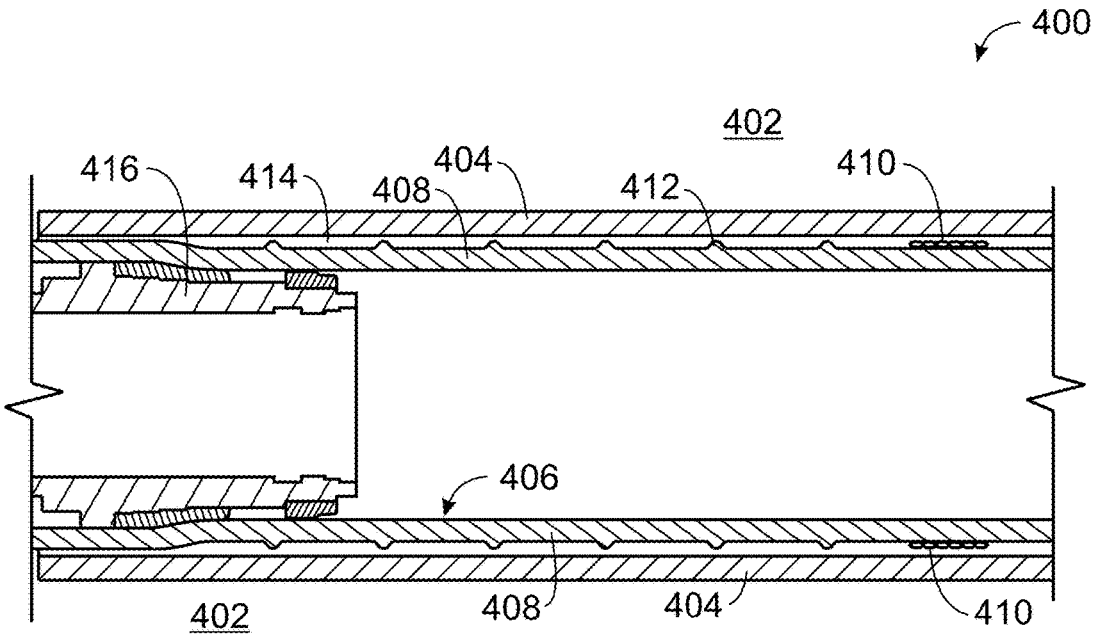
FIG. 4 is a diagram of a wellbore having an expandable liner hanger (ELH).

FIG. 4 is a wellbore 400 formed in a subterranean formation 402 in the Earth crust. To the left is uphole. To the right is downhole. The wellbore has a casing 404 (e.g., metal). Situated in the wellbore 400 is an expandable liner hanger (ELH) 406 having a body 408. The ELH 406 has an expandable sealing sleeve 410 coupled to the OD of the body 408. In embodiments, the expandable sealing sleeve 410 is 3D printed onto the body 408 and thus is attached to the OD of the body 408. The ELH 406 has raised portions 412 (e.g., metal and/or elastomer that can be spikes, ribs, etc.) on the OD of the body 408.

In operation, the ELH 406 may employ the raised portions 412 and the expandable sealing sleeve 410 to form a MTM seal(s) with the casing 404. The MTM seal(s) can give a fluid seal, hydraulic seal, seal against pressure, seal against fluid flow, etc. formed in the annulus 414 between the ELH 406 and the wellbore casing 404. In the illustrated embodiment, the ELH 406 has a cone mandrel 416 (e.g., metal and generally cylindrical) to radially expand the ELH body 408. The cone mandrel 416 may interact (work in conjunction) with a running tool or setting tool (e.g., expansion cone, etc.) to apply force and cause the ELH 406 to expand against the wellbore casing 404.

A raised portion 412 can be, for example, a spike (as depicted) or a spike form, a ring, ridges, ribs, and/or a band, and so forth. One or more raised portions 412 can be metal and thus for a MTM seal in addition to the MTM seal(s) formed with the expandable sealing sleeve 410. One or more raised portions 412 can be an elastomer and thus form a seal that is not a MTM seal. A rubber sleeve can be a raised portion 412, or in alternate implementations, the rubber sleeve can be a sealing element not labeled as a raised portion 412.

Figure 5:
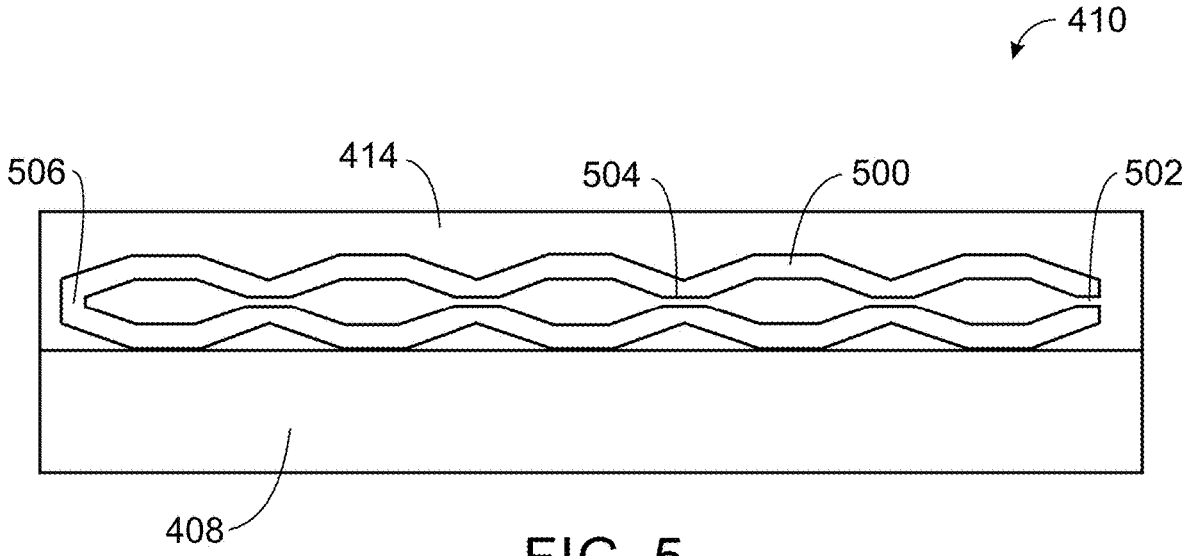
FIG. 5 is a diagram of the expandable sealing sleeve of FIG. 4.

FIG. 5 is an example of the expandable sealing sleeve 410 (of the ELH 406 of FIG. 4) situated on (e.g., attached to) the ELH body 408. The expandable sealing sleeve 410 is configured to expand in the annulus 414 toward the casing (not shown). In this example, the expandable sealing sleeve 410 has five coupled hollow members 500. The expandable sealing sleeve 410 has a microchannel 502 at the downhole end to receive fluid into the interior volume of the expandable sealing sleeve 410 from the wellbore that pressurizes (and thus expands) the expandable sealing sleeve 410. The expandable sealing sleeve 410 has four intermediate microchannels 504 to provide for introduction of (and thus pressurization by) the fluid throughout the interior volume of expandable sealing sleeve 410. In the depicted embodiment, the expandable sealing sleeve 406 is closed at the uphole end 506.

Figure 6:
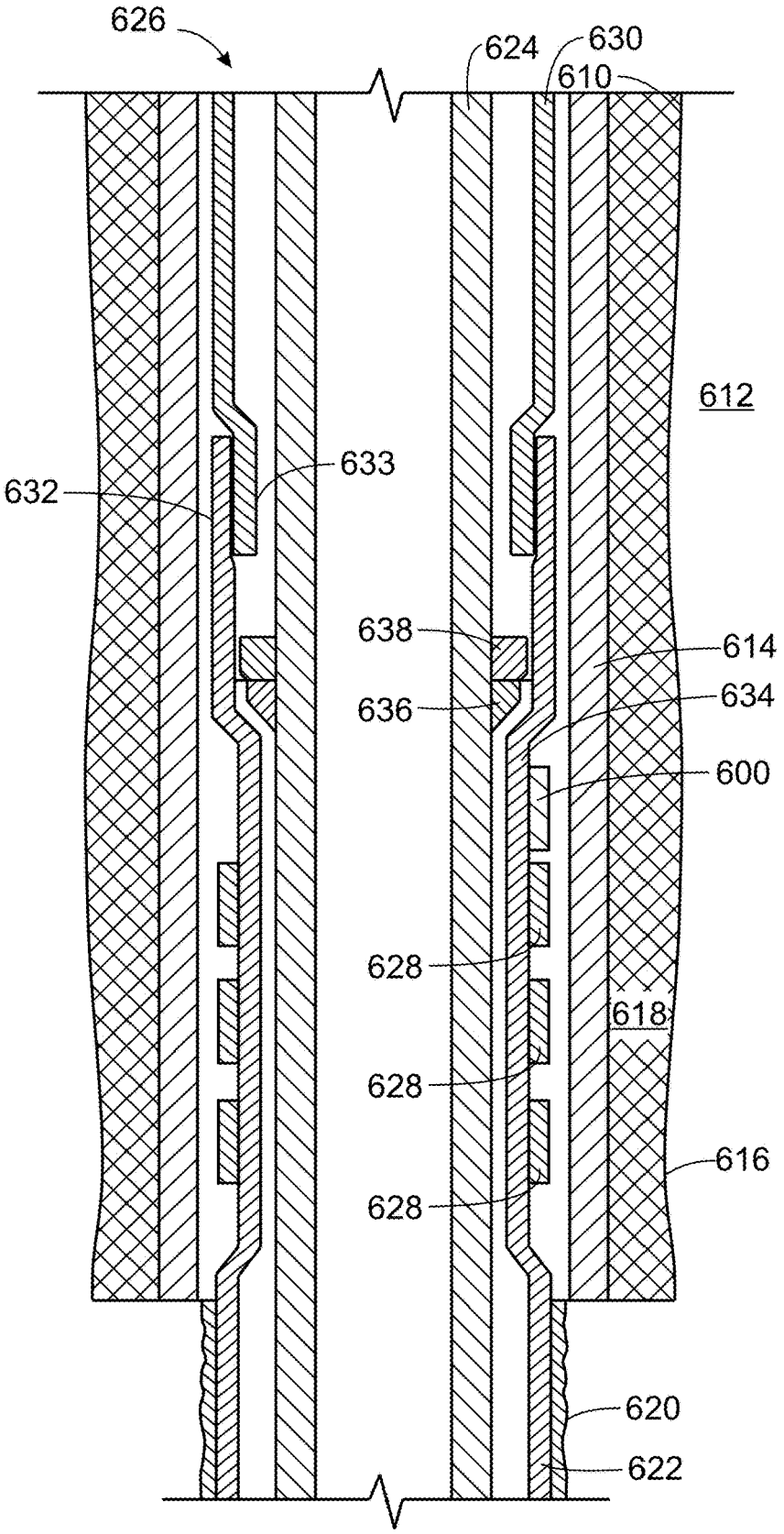
FIG. 6 is a diagram of an ELH having an expandable sealing sleeve.

FIG. 6 depicts an expandable liner hanger (ELH) that can incorporate seals (sealing elements) including an expandable sealing sleeve 600, as discussed. An ELH is a downhole tool in that is deployed in a wellbore. An ELH can be a downhole tool utilized to suspend and secure a liner string (a section of casing) within a previously installed wellbore casing. After the liner is hung, the liner can be cemented in place to provide zonal isolation and wellbore integrity. Cement may be employed (injected) to install (secure) casing in a wellbore and prevent migration of fluids in the annulus between the casing and the wellbore wall.

Once an upper portion of the wellbore has been drilled and cased, it may be desirable to continue drilling and to line a lower portion of the wellbore with a liner lowered through the upper cased portion thereof. Liner hangers are typically used to mechanically support an upper end of the liner from the lower end of a previously installed casing. Additionally, liner hangers may be used to seal the liner to the casing.

ELHs can utilize rings, spikes, ribs, etc. as seals or sealing elements carried on a section of expandable tubing (body) to provide both mechanical support and a fluid seal. These seals or sealing elements can be elastomer (rubber) and/or metal. Once the ELH is placed at a desired position downhole within a casing, an expansion cone may be forced through the ELH. The expansion cone expands the ELH body bringing these sealing elements into contact with the wellbore casing to provide both mechanical support and a fluid seal between the casing and a liner.

As indicated in FIG. 6, a borehole as wellbore 610 may be drilled through the Earth surface into a subterranean formation in the Earth crust. A casing 614 may be placed in an upper portion 616 of the wellbore 610 and held in place by cement 618 that is injected between the casing 614 and the upper portion 616 of wellbore 610 wall (formation 612 face in this example). Once the casing 614 is installed, the casing 614 can be considered the wellbore 610 wall of the upper portion 616. With the casing 614 installed, the upper portion 616 may be called a cased borehole or cased wellbore. The inner (inside diameter) surface of the casing 614 may be considered the inner surface (inside diameter) of the wellbore 610 in the upper portion 616.

Below the casing 614, a borehole as a lower portion 620 of the wellbore 610 may be drilled beyond the casing 614. The lower portion 620 may have a smaller diameter than the upper portion 616. A length of liner 622 is shown positioned within the lower portion 620. The liner 622 may line or case the lower portion 620 and/or be utilized to drill the lower portion 620. If desired, cement 618 may be placed adjacent to the liner 622 in the lower portion 620 of the wellbore. The cement 618 may be placed between the liner 622 and the wellbore 610 wall or formation 612 face of the wellbore 610. The liner 622 may be installed in the wellbore 610 via (by means of) a work string 624. The work string 624 may include a releasable collet (not shown) by which the work string 624 can support and rotate the liner 622 as it is placed in the wellbore 610.

Attached to the upper end of, or formed as an integral part of, liner 622 is a liner hanger 626 (deployed in the wellbore 610) which may include a number of raised portions 628 that may be annular seals (sealing elements) and/or anchors. The raised portions 628 may form a seal with the inside surface of the casing 614 as an adjacent surface. While three raised portions 628 are depicted for illustrative purposes, any number of raised portions 628 (e.g., seals, anchors, etc.) may be used. The raised portion 628 (e.g., elastomer and/or metal) can be, for example, a rib or ribs, a spike or spike form, a ring, ridges, and/or a band, or any combinations thereof.

The expandable sealing sleeve 600 having hollow members to receive wellbore fluid driven by wellbore pressure can be as previously discussed, such as with respect to the preceding figures and variations thereof. The expandable sealing sleeve 600 is situated on the body 634 of the liner hanger 626. The expandable sealing sleeve 600 is depicted as above the top raised portion 628. However, the expandable sealing sleeve 600 can instead be below the bottom raised portion 628 or between raised portions 628.

A polished bore receptacle 630 (or tie back receptacle) may be coupled to the upper end of the liner hanger 626. The polished bore receptacle 630 may be coupled to the liner hanger 626 by a threaded joint 632, but a different coupling mechanism may be employed. The inner bore of the polished bore receptacle 630 may be smooth and machined to close tolerance to permit work strings, production tubing, etc. to be connected to the liner 622 in a fluid-tight and pressure-tight manner. For instance, a work string may be connected via the polished bore receptacle 630 and used to pump fracturing fluid at high pressure down to the lower portion 620 of the wellbore 610 without exposing the casing 614 to the fracturing pressure.

It may be desirable that the outer diameter of liner 622 be as large as possible while being able to lower the liner 622 through the casing 614. It may also desirable that the outer diameter of the polished bore receptacle 630 and the liner hanger 626 be about the same as the diameter of liner 622. In implementations for the run in condition, the outer diameter of liner hanger 626 is defined by the outer diameter of the raised portions 628 (e.g., annular seals). In implementations for the run in condition, a body or mandrel 634 of liner hanger 626 has an outer diameter reduced by about the thickness of the raised portions 628 (e.g., seals) so that the outer diameter of the raised portions 628 is about the same as the outer diameter of liner 622 and tie back receptacle 630.

In this implementation, first and second expansion cones 636 and 638 may be carried on the work string 624 just above the reduced diameter body 634 of the liner hanger 626. Fluid pressure applied between the work string 624 and the liner hanger 626 may be used to drive the cones 636, 638 downward through the liner hanger 626 to expand the body 634 to an outer diameter at which the raised portions 628 are forced into sealing and/or supporting contact with the casing 614. The first expansion cone 636 may be a solid, or fixed diameter, cone having a fixed outer diameter smaller than the inner diameter 633 of the threaded joint 632. In the run in condition, second expansion cone 638 may have an outer diameter greater than first cone 636 and also greater than the inner diameter 633 of the threaded joint 632. In an embodiment, the second expansion cone 638 may be collapsible, that is, may be reduced in diameter smaller than the inner diameter 633 of the threaded joint 632 when it needs to be withdrawn from the liner hanger 626. In some contexts, the second expansion cone 638 may be referred to as a collapsible expansion cone. After the liner hanger 626 is expanded, expansion cones 636, 638 may be withdrawn from the liner hanger 626, through the polished bore receptacle 630 and out of the wellbore 610 with the work string 624.

An embodiment is an expandable liner hanger including a raised portion (e.g., a rib, a spike, a ring, ridges, a band, or a rubber sleeve, or any combinations thereof) as a sealing element to engage a casing in a wellbore to form a first seal between the expandable liner hanger and the casing. The expandable liner hanger includes an expandable sealing sleeve attached to a body of the expandable liner hanger to engage the casing to form a second seal between the expandable liner hanger and the casing. The expandable sealing sleeve (e.g., a pressure-energized sleeve) has hollow members to receive fluid from the wellbore to expand the expandable sealing sleeve. In implementations, the expandable sealing sleeve is attached to an OD surface of the body. In implementations, the hollow members receiving the fluid pressurizes the expandable sealing sleeve to expand the expandable sealing sleeve, and wherein the expandable sealing sleeve comprises a microchannel (e.g., a diameter less than 100 microns) to receive the fluid into an interior volume of one or more of the hollow members. In implementations, the expandable sealing sleeve includes at least one microchannel to fluidly couple the hollow members. In implementations, the expandable sealing sleeve is or includes metal, and wherein the second seal is a MTM seal. The expandable sealing sleeve can be 3D printed material, such as 3D printed onto the body. In implementations, the expandable liner hanger is configured to form and maintain the second seal at a pressure of the fluid up to 17,000 psig and at least 17,000 psig.

Another embodiment is a method of deploying an expandable liner hanger, including moving the expandable liner hanger to a selected position in a wellbore, wherein the expandable liner hanger has at least one raised portion and an expandable sealing sleeve. The method includes engaging wellbore casing in the wellbore with the raised portion (e.g., a rib, a spike, a ring, ridges, a band, or a rubber sleeve, or any combinations thereof) to form a first seal between the expandable liner hanger and the wellbore casing. The method includes engaging the wellbore casing with the expandable sealing sleeve (e.g., attached to the OD of a body of the expandable liner hanger) to form a second seal between the expandable liner hanger and the wellbore casing. In implementations, the method includes expanding the expandable sealing sleeve to maintain the second seal, wherein expanding the expandable sealing sleeve (e.g., a pressure-energized sleeve) involves receiving fluid from the wellbore into an interior volume of the expandable sealing sleeve. In implementations, the method includes maintaining the second seal at a pressure in the wellbore of up to and at least 17,000 pounds per square inch gauge (psig) acting against the second seal. In implementations, the expandable sealing sleeve is fabricated by additive manufacturing involving 3D printing. In implementations, the expandable sealing sleeve is 3D printed onto a body of the expandable liner hanger.

Yet another embodiment is an expandable liner hanger having an expandable sealing sleeve attached to a body (e.g., attached to an OD surface of the body) of the expandable liner hanger to engage a casing in a wellbore to form a seal (e.g., MTM seal) between the expandable liner hanger and the casing. The expandable sealing sleeve includes hollow members to receive fluid from the wellbore to expand the expandable sealing sleeve. In implementations, the expandable sealing sleeve includes a microchannel to receive the fluid. In implementations, the expandable liner hanger includes a raised portion as a sealing element to engage the casing in the wellbore to form a second seal between the expandable liner hanger and the casing. In implementations, the expandable liner hanger includes a rubber sleeve as a sealing element to engage the casing in the wellbore to form a second seal between the expandable liner hanger and the casing, wherein the rubber sleeve is in addition to the expandable sealing sleeve.

In view of the foregoing, the present disclosure may provide expandable liner hangers having an expandable sealing sleeve as a sealing element. The methods, systems, and tools may include any of the various features disclosed herein, including one or more of the following statements.

Statement 1. An expandable liner hanger comprising: a raised portion as a sealing element to engage a casing in a wellbore to form a first seal between the expandable liner hanger and the casing; and an expandable sealing sleeve attached to a body of the expandable liner hanger to engage the casing to form a second seal between the expandable liner hanger and the casing, the expandable sealing sleeve comprising hollow members to receive fluid from the wellbore to expand the expandable sealing sleeve.

Statement 2. The expandable liner hanger of Statement 1, wherein the expandable sealing sleeve is attached to an outer diameter (OD) surface of the body, and wherein the expandable sealing sleeve comprises a pressure-energized sleeve.

Statement 3. The expandable liner hanger of Statement 1 or Statement 2, wherein the hollow members receiving the fluid pressurizes the expandable sealing sleeve to expand the expandable sealing sleeve, and wherein the expandable sealing sleeve comprises a microchannel to receive the fluid into an interior volume of the hollow members.

Statement 4. The expandable liner hanger of Statement 3, wherein the microchannel comprises a diameter less than 100 microns.

Statement 5. The expandable liner hanger of any preceding Statement, wherein the expandable sealing sleeve comprises at least one microchannel to fluidly couple the hollow members, wherein the expandable sealing sleeve comprises metal, and wherein the second seal comprises a metal-to-metal (MTM) seal.

Statement 6. The expandable liner hanger of any preceding Statement, wherein the expandable sealing sleeve comprises three-dimensional (3D) printed material.

Statement 7. The expandable liner hanger of any preceding Statement, wherein the expandable sealing sleeve is 3D printed onto the body.

Statement 8. The expandable liner hanger of any preceding Statement, wherein the expandable liner hanger is configured to form and maintain the second seal at a pressure of the fluid up to 17,000 pounds per square inch gauge (psig) and at least 17,000 psig.

Statement 9. The expandable liner hanger of any preceding Statement, wherein the raised portion comprises a rib, a spike, a ring, ridges, a band, or a rubber sleeve, or any combinations thereof.

Statement 10. A method of deploying an expandable liner hanger, comprising: moving the expandable liner hanger to a selected position in a wellbore, wherein the expandable liner hanger comprises a raised portion and an expandable sealing sleeve; engaging wellbore casing in the wellbore with the raised portion to form a first seal between the expandable liner hanger and the wellbore casing; and engaging the wellbore casing with the expandable sealing sleeve to form a second seal between the expandable liner hanger and the wellbore casing.

Statement 11. The method of Statement 10, comprising expanding the expandable sealing sleeve to maintain the second seal, wherein expanding the expandable sealing sleeve comprises receiving fluid from the wellbore into an interior volume of the expandable sealing sleeve, and wherein the expandable sealing sleeve comprises a pressure-energized sleeve.

Statement 12. The method of Statement 11, comprising maintaining the second seal at a pressure in the wellbore up to and at least 17,000 pounds per square inch gauge (psig) acting against the second seal.

Statement 13. The method of Statements 10-12, wherein the expandable sealing sleeve is attached to an outer diameter (OD) of a body of the expandable liner hanger.

Statement 14. The method of Statements 10-13, wherein the expandable sealing sleeve is fabricated by additive manufacturing comprising three-dimensional (3D) printing.

Statement 15. The method of Statements 10-14, wherein the expandable sealing sleeve is 3D printed onto a body of the expandable liner hanger.

Statement 16. The method of Statements 10-15, wherein the raised portion comprises a rib, a spike, a ring, ridges, a band, or a rubber sleeve, or any combinations thereof.

Statement 17. An expandable liner hanger comprising an expandable sealing sleeve attached to a body of the expandable liner hanger to engage a casing in a wellbore to form a seal between the expandable liner hanger and the casing, the expandable sealing sleeve comprising hollow members to receive fluid from the wellbore to expand the expandable sealing sleeve.

Statement 18. The expandable liner hanger of Statement 17, wherein the expandable sealing sleeve is attached to an outer diameter (OD) surface of the body, wherein the expandable sealing sleeve comprises a microchannel to receive the fluid, and wherein the seal comprises a metal-to-metal (MTM) seal.

Statement 19. The expandable liner hanger of Statement 17 or Statement 18, comprising a raised portion as a sealing element to engage the casing in the wellbore to form a second seal between the expandable liner hanger and the casing.

Statement 20. The expandable liner hanger of Statements 17-19, comprising a rubber sleeve as a sealing element to engage the casing in the wellbore to form a second seal between the expandable liner hanger and the casing, wherein the rubber sleeve is in addition to the expandable sealing sleeve.

Example

Figure 7:
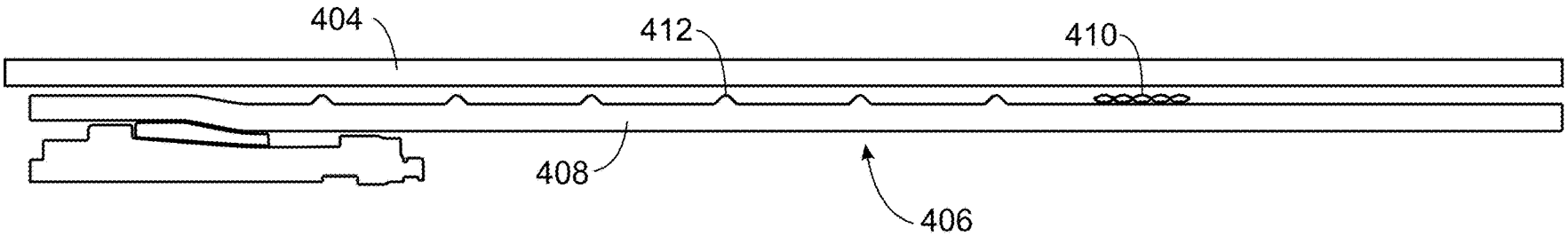
FIG. 7 is a diagrammatical representation of an ELH in a wellbore in the Example.

FIG. 7 is a representation of an ELH 406 in a wellbore adjacent the wellbore casing 404 in this Example. The configuration is based on that in FIGS. 4-5. The ELH has a body 408, an expandable sealing sleeve 410 (as discussed) on the body 408, and six raised portions 412 as sealing elements. In this Example, the expandable sealing sleeve 410 has five hollow members (e.g. hollow members 500 as configured in FIG. 5).

The depiction of FIG. 7 is a view in a finite element analysis (FEA) software utilized to perform comparative studies (analyses) of liner hangers at below pressure conditions. The baseline liner hanger (not depicted) was successfully tested to below pressure of 14,000 psig and external pressure of 7,000 psig. External pressure is the pressure applied outside the casing. In the software analysis, this external pressure is applied to mimic the reaction force experienced from the casing downhole. The casing is cemented downhole and will generally not bulge out. This external pressure behavior can be simulated in a validation test. Hence, an external pressure is applied to simulate this behavior. The temperature includes ambient in the study. The temperature was a high temp of 325° F. and low temperature of 93° F. in the test. In the FEA, the temperature is ambient. The depiction in FIG. 7 is for the liner hanger having the expandable sleeve, and prior to expansion.

Figure 8:
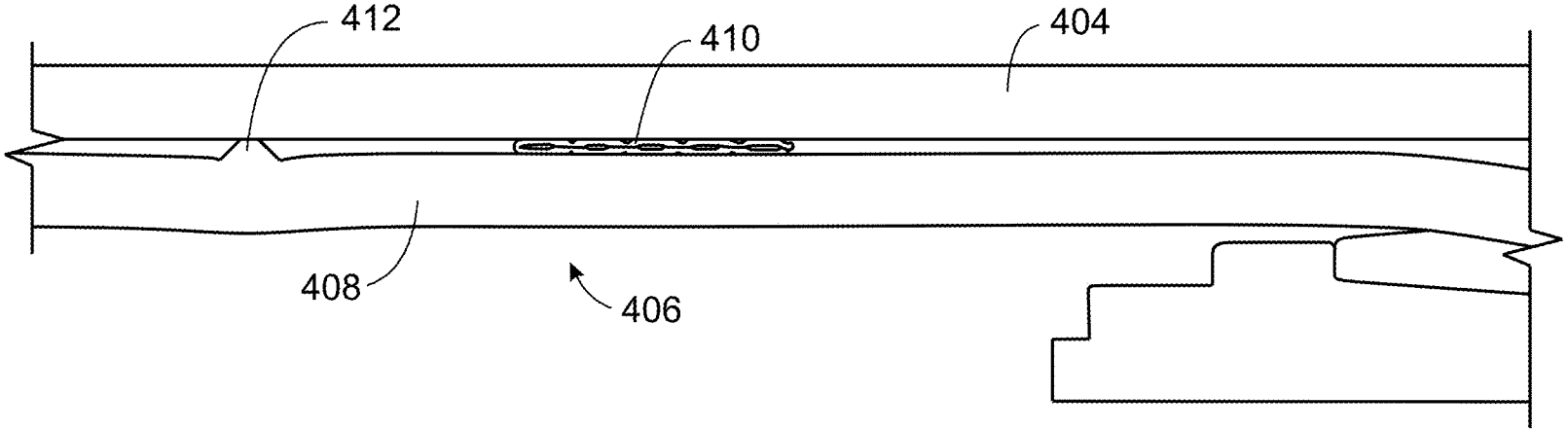
FIG. 8 is a diagrammatical representation of the ELH of FIG. 7 after expansion.

FIG. 8 is a representation of the ELH 406 of FIG. 7 after expansion of the ELH 406 against the wellbore casing 404 in this Example. The expandable sealing sleeve 410 forms a seal with the casing 404. The depiction of FIG. 8 is a view in the FEA software. FIG. 8 depicts the post expanded state of the sleeve before pressure is applied.

Figure 9:
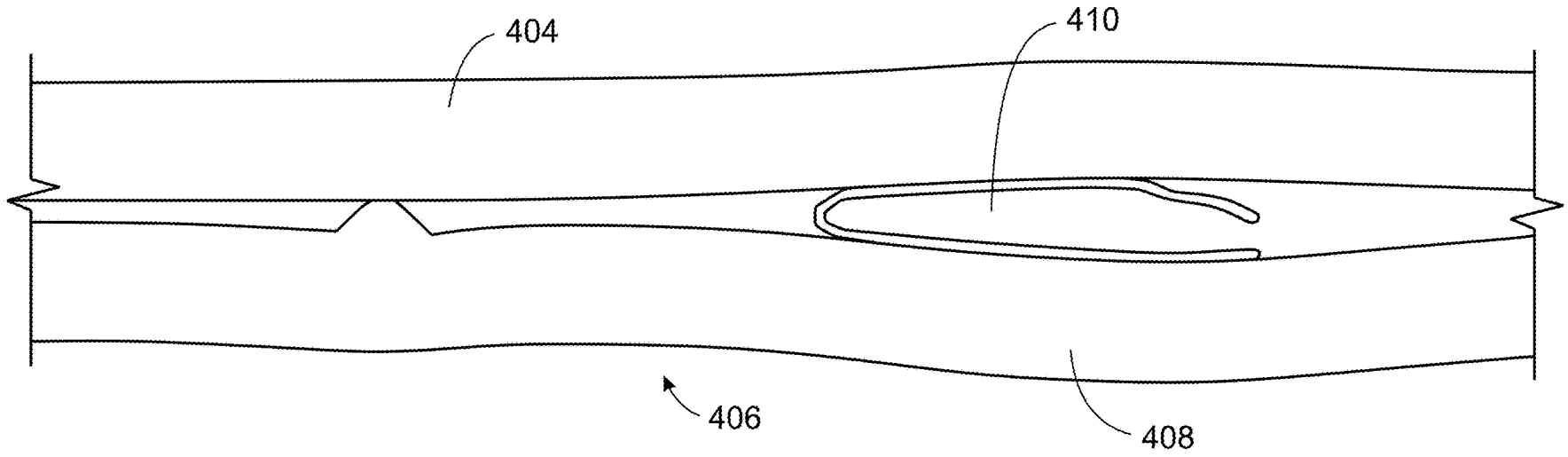
FIG. 9 is a diagrammatical representation of the ELH of FIG. 7 after expansion and with wellbore below pressure acting on the ELH.

FIG. 9 is a representation of the ELH 406 of FIG. 8 after expansion of the ELH 406 and with the expandable sealing sleeve 410 forming the seal with the casing 404, and with wellbore below pressure acting on the ELH 406 and the seal in this Example. The expandable sealing sleeve 410 is shown as simplified representation without defined hollow members. The expandable sealing sleeve 410 is shown as expanded (due to the wellbore below pressure), thereby maintaining the seal of the expandable sealing sleeve 410 with the casing 404. The depiction of FIG. 9 is a view in the FEA software. The results show that the expandable that the expandable sealing sleeve sealed against up to 20,000 psig below pressure. As pressure is applied, the sleeve starts to deform and create a seal between the hanger and the casing. As more and more pressure is applied, the sleeve bulges out in proportion, thus, this acts as a re-energizing seal. More the applied pressure, generally better is the seal within the pressure rating.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

The present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An expandable liner hanger comprising:

a raised portion as a sealing element to engage a casing in a wellbore to form a first seal between the expandable liner hanger and the casing; and an expandable sealing sleeve attached to a body of the expandable liner hanger to engage the casing to form a second seal between the expandable liner hanger and the casing, the expandable sealing sleeve comprising hollow members to receive fluid from the wellbore to expand the expandable sealing sleeve, wherein the hollow members receiving the fluid pressurizes the expandable sealing sleeve to expand the expandable sealing sleeve, and wherein the expandable sealing sleeve comprises a microchannel to receive the fluid into an interior volume of the hollow members.

2. The expandable liner hanger of claim 1, wherein the expandable sealing sleeve is attached to an outer diameter (OD) surface of the body, and wherein the expandable sealing sleeve comprises a pressure-energized sleeve.

3. The expandable liner hanger of claim 1, wherein the microchannel comprises a diameter less than 100 microns.

4. The expandable liner hanger of claim 1, wherein the expandable sealing sleeve comprises at least one microchannel to fluidly couple the hollow members, wherein the expandable sealing sleeve comprises metal, and wherein the second seal comprises a metal-to-metal (MTM) seal.

5. The expandable liner hanger of claim 1, wherein the expandable sealing sleeve is 3D printed onto the body.

6. The expandable liner hanger of claim 1, wherein the expandable liner hanger is configured to form and maintain the second seal at a pressure of the fluid up to 17,000 pounds per square inch gauge (psig) and at least 17,000 psig.

7. The expandable liner hanger of claim 1, wherein the raised portion comprises a rib, a spike, a ring, ridges, a band, or a rubber sleeve, or any combinations thereof.

8. An expandable liner hanger comprising:

a raised portion as a sealing element to engage a casing in a wellbore to form a first seal between the expandable liner hanger and the casing; and an expandable sealing sleeve attached to a body of the expandable liner hanger to engage the casing to form a second seal between the expandable liner hanger and the casing, the expandable sealing sleeve comprising hollow members to receive fluid from the wellbore to expand the expandable sealing sleeve, wherein the expandable sealing sleeve comprises three-dimensional (3D) printed material.

9. A method of deploying the expandable liner hanger of claim 1, comprising:

moving the expandable liner hanger of claim 1 to a selected position in the wellbore;

engaging the casing in the wellbore with the raised portion to form the first seal between the expandable liner hanger and the casing; and engaging the casing with the expandable sealing sleeve to form the second seal between the expandable liner hanger and the casing.

10. The method of claim 9, comprising expanding the expandable sealing sleeve to maintain the second seal, wherein expanding the expandable sealing sleeve comprises receiving fluid from the wellbore into the interior volume of the expandable sealing sleeve, and wherein the expandable sealing sleeve comprises a pressure-energized sleeve.

11. The method of claim 10, comprising maintaining the second seal at a pressure in the wellbore up to and at least 17,000 pounds per square inch gauge (psig) acting against the second seal.

12. The method of claim 9, wherein the expandable sealing sleeve is attached to an outer diameter (OD) of a body of the expandable liner hanger.

13. The method of claim 9, wherein the expandable sealing sleeve is fabricated by additive manufacturing comprising three-dimensional (3D) printing.

14. The method of claim 9, wherein the expandable sealing sleeve is 3D printed onto a body of the expandable liner hanger.

15. The method of claim 9, wherein the raised portion comprises a rib, a spike, a ring, ridges, a band, or a rubber sleeve, or any combinations thereof.

16. An expandable liner hanger comprising an expandable sealing sleeve attached to a body of the expandable liner hanger to engage a casing in a wellbore to form a seal between the expandable liner hanger and the casing, the expandable sealing sleeve comprising hollow members to receive fluid from the wellbore to expand the expandable sealing sleeve, wherein the expandable sealing sleeve is attached to an outer diameter (OD) surface of the body, wherein the expandable sealing sleeve comprises a micro-channel to receive the fluid, and wherein the seal comprises a metal-to-metal (MTM) seal.

17. The expandable liner hanger of claim 16, comprising a raised portion as a sealing element to engage the casing in the wellbore to form a second seal between the expandable liner hanger and the casing.

18. The expandable liner hanger of claim 16, comprising a rubber sleeve as a sealing element to engage the casing in the wellbore to form a second seal between the expandable liner hanger and the casing, wherein the rubber sleeve is in addition to the expandable sealing sleeve.

* * * * *